US005920476A

United States Patent [19]

Hennessey et al.

[11] Patent Number: 5,920,476

[45] Date of Patent: Jul. 6, 1999

[54] COMPUTER CONTROLLED MOVEMENT OF STAGE EFFECTS AND STAGE INSTALLATION EMPLOYING SAME

[76] Inventors: John M. Hennessey, 52 Yawpo Ave., Oakland, N.J. 07436; Michael K. Wyatt, 186 West St., Closter, N.J. 07624

[21] Appl. No.: 08/752,856

[22] Filed: Nov. 21, 1996

[51] Int. Cl.[6] ..... G05B 11/01; A63J 1/02; E04H 3/26

[52] U.S. Cl. ..... 364/146; 472/77; 52/7

[58] Field of Search ..... 364/146, 138, 364/147, 188, 189; 144/382; 345/1; 493/14; 472/77; 52/7

[56] References Cited

U.S. PATENT DOCUMENTS

| | | | |
|---|---|---|---|
| 4,404,551 | 9/1983 | Howse et al. | 345/1 |
| 4,662,628 | 5/1987 | Chatenay | 472/77 |
| 4,924,151 | 5/1990 | D'Aeo et al. | 315/295 |
| 4,962,420 | 10/1990 | Judenich | 348/744 |
| 5,003,442 | 3/1991 | Gallo et al. | 362/225 |
| 5,041,070 | 8/1991 | Blaser | 493/14 |
| 5,106,057 | 4/1992 | Feller et al. | 254/334 |
| 5,253,160 | 10/1993 | Lin | 364/188 |
| 5,386,360 | 1/1995 | Wilson et al. | 364/146 |
| 5,392,207 | 2/1995 | Wilson et al. | 364/167.1 |
| 5,406,176 | 4/1995 | Sugden | 315/292 |
| 5,414,328 | 5/1995 | Hunt et al. | 315/316 |
| 5,437,044 | 7/1995 | Hohner et al. | 395/892 |
| 5,452,201 | 9/1995 | Pieronek et al. | 364/188 |
| 5,465,215 | 11/1995 | Strickland et al. | 364/474.22 |
| 5,493,281 | 2/1996 | Owens | 340/825.24 |
| 5,676,187 | 10/1997 | Owens et al. | 144/382 |

*Primary Examiner*—William Grant
*Assistant Examiner*—Carolyn T. Baumgardner
*Attorney, Agent, or Firm*—Pepe & Hazard

[57] ABSTRACT

Stage effects are moved by a computer which has stored data indicative of individual stage effects to be moved, their start and finish positions, the speed of movement, and timing and order of movement. The computer controls drive assemblies for moving the effects by a program which, while the program is running, displays on the monitor data concerning movement of the effects and enables the operator to modify at least some of the data previously established.

23 Claims, 12 Drawing Sheets

| EFF | 001 | 002 | 003 | 004 | 005 | 009 | 010 | 011 |
|---|---|---|---|---|---|---|---|---|
| CUE | | | | | | | | |
| 0001 | 0' 000" | 0' 0010" | 0' 0010" | 0' 0012" | 0' 0035" | 169.7" | 161.2 | 10.0" |
| 0010 | 3' 0060" | | | 3' 0040" | 1' 0005" | 70.0" | 70.0" | 70.0 |
| 0020 | | 4' 0015" | | | | | | |
| AF | | 0150" | | | | | | |
| 0030 | | | | | | | | |
| AF | | | | | | | | |
| 0040 | | 9' 0200" | | | | | | |
| AF | | 0010" | | | | | | |
| 0050 | | | | | | | | |
| AF | | | | | | | | |
| 0060 | | | | | 5' 0015" | | | |
| AF | | | | | 0150" | | | |
| 0070 | | | | | | | | |
| AF | | | | | 17' 0060" | | | |
| 0080 | | | | | | | | |
| AF | | 0400" | | | | 10.0" | 10.0" | 10.0" |
| 0090 | | | | | | | | |
| AF | | | | | 0300" | | | |
| 0100 | | | | | 9' 0050" | | | 70.0" |
| 0110 | | 19" 0010" | | | 19' 0010" | | 70.0" | |
| 0120 | | 9' 0200" | | | 9' 0350" | | 10.0" | |

TO FIG. 4B

FIG. 4A

/SCR:TEACH & LEARN / MON, NOV.1, 1996 01:45:05PM-->3 [X]

| TEACH & LEARN MODE | REAL TIME MODE | ALARMS: 0 UNACKED: 0 |
|---|---|---|

O NO AUTO FOLLOW
O AUTO FOLLOW EFFECT EFFECT #
O TIMED AUTO FLOW LOC/TIME

| SUB MSTR | POSITION CURR | TARGET/S CURR | MODE NEW | ACC CURR | TIME NEW | DCC CURR | TIME NEW | VOL/TIME CURR | | NEW | SPEED % |
|---|---|---|---|---|---|---|---|---|---|---|---|
| 1234 | | | | | | | | | V | | |
| 1234 | | | | | | | | | V | | |
| 1234 | | | | | | | | | V | | |
| 1234 | | | | | | | | | V | | |
| 1234 | | | | | | | | | V | | |
| | | | | | | | | | | | |
| | | | | | | | | | | | |
| | | | | | | | | | | | |
| 1234 | | | | | | | | | V | | |
| 1234 | | | | | | | | | V | | |
| 1234 | | | | | | | | | V | | |
| 1234 | | | | | | | | | V | | |
| 1234 | | | | | | | | | V | | |
| 1234 | | | | | | | | | V | | |
| 1234 | | | | | | | | | V | | |
| | | | | | | | | | | | |
| 1234 | | | | | | | | | V | | |
| 1234 | | | | | | | | | V | | |
| 1234 | | | | | | | | | V | | |
| | | | | | | | | | | | |
| 1234 | | | | | | | | | V | | |
| | | | | | | | | | | | |
| | | | | | | | | | | | |
| | | | | | | | | | | | |
| 1234 | | | | | | | | | V | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| 1234 | | | | | | | | | V | | |
| 1234 | | | | | | | | | V | | |
| 1234 | | | | | | | | | V | | |
| 1234 | | | | | | | | | V | | |
| 1234 | | | | | | | | | V | | |

| TARGET NEW | EFFECT NUMBER/ DESCRIPTION | POSITION CURR | TARGET CURR | NEW |
|---|---|---|---|---|
| | SLOT ELEV | | | |
| | DOR ELEV | | | |
| | MAIN EVENT ELEV | | | |
| | RIVERBOAT PADDLE | | | |
| | ROLL DROP TENMO | | | |

FROM FIG. 8A

FIG. 8B

COMPUTER CONTROLLED MOVEMENT OF STAGE EFFECTS AND STAGE INSTALLATION EMPLOYING SAME

BACKGROUND OF THE INVENTION

The present invention relates to computer controlled operation of stage elements including props and battens and, more particularly, to computer installations and software which enable operator interaction during operation of programmed instructions.

During a stage production, it is desirable to effect movement of wings and props between scenes and even during a scene. Because of the costs and time necessary to effect such movement manually, there has been an increasing tendency to provide motorized movement under control of microprocessors providing signals in accordance with programmed data. Similarly, there has been extensive use of computer installations in stage lighting and sound generation. Use of computers also minimizes the potential for misunderstood directions and improper execution of instructions, and/or sequence of execution.

Illustrative of a computer controlled lighting systems are D'Aleo et al U.S. Pat. No. 4,924,151 granted May 8, 1990, and Sugden et al U.S. Pat. No. 5,406,176 granted Apr. 11, 1995. Illustrative of computer controlled image generation in a multipanel display is Judenich U.S. Pat. No. 4,962,420 granted Oct. 9, 1990.

Although computer controlled movement of effects has enjoyed successful application to theatrical productions, the time for programming and the difficulty of modifying the program tend to limit use of such computer controlled systems to productions of relatively long duration at a single facility. Moreover, it has heretofore been difficult, it not impossible, to modify the movement parameters of an effect while the program is running, and to display graphically before the operator the movement of the effects which are being produced by the operation of the program.

Programming has generally required extensive entry of code to reflect all of the movement parameters, and adjustment of any parameter has been difficult. Evaluation of the operation of the program or of any changes has generally required actual operation of the drive elements and movement of the effects.

As referred to herein, "effect" describes a single prop or batten (curtain or backdrop), or of a device which is turned on or off. As referred to herein, "cue" describes a group of moves or changes in on/off condition of effects during the production.

It is an object of the present invention to provide a novel method for computer controlled movement of effects which permits online modification of movement parameters during operation of the program.

It is also an object to provide such a method in which programming of the positioning of effects can be effected on a display monitor.

Another object is to provide such a method in which the computer program enables simulation and emulation of the program on the display monitor.

A further object is to provide a novel computer controlled installation for management of movement of stage effects which enables online modification of movement parameters during operation of the program.

Yet another object is to provide such a computer controlled installation in which a novel interface enables manual operation of analog controls over movement parameters.

SUMMARY OF THE INVENTION

It has now been found that the foregoing and related objects may be readily attained by providing a computer installation including a computer having memory, a monitor and a keyboard control, and entering into the memory of the computer data indicative of individual stage effects to be moved, their initial position, a second position to which they are to be moved and the speed of such movement. The method also enters into the memory of the computer data indicative of the order in which the effects are to be moved.

The computer is coupled to drive assemblies for each of the effects to be moved, and the drive assemblies are each operable to move one of the effects between the initial and second positions. The computer is provided with a program to utilize the entered data to operate the drive assemblies in the entered order to move the effects between the initial and second positions.

The computer program is run to effect the movement of the effects and, while the program is running, data concerning movement of the effects is displayed on the monitor and the operator uses the keyboard to modify at least some of the data with respect to at least one of the effects.

Desirably, programmable logic controllers for the drive assemblies are provided to execute the movement of the effects defined by the entered data. The computer keyboard includes at least one manually variable controller for varying the speed of movement of at least one of the effects, and the variable controller is manually moved to vary the operation of at least one of the logic controllers and thereby the speed of the drive assembly associated therewith. Preferably, a manually variable controller is provided for each of a selected multiplicity of effects, and each of the variable controllers may be selectively operated. A master variable controller is desirably provided for all of the effects and it is operated to vary the speed of movement of all of the effects.

A variable jog controller may also be provided, and an effect to be operated thereby is selected. The joy controller is manually operated to control the movement and speed of movement of the selected effect.

In one mode of operation, the keyboard is used to move an icon representing an effect to a desired position on the monitor, and data indicative of the selected position entered into the memory. A simulation mode is desirably provided in the computer program whereby the steps of the program may be executed and data of the simulated movement presented graphically on the monitor. An emulation mode may also be provided in the computer program to enable emulation of movement of effects by the operator and the entering into the memory data representative of the emulated movement.

The keyboard desirably includes a multiplicity of "hot keys" and a multiplicity of the effects is assigned to individual "hot keys". At least one of the hot keys is operated to disable movement of the associated effect while the program is running the program may also enable the superposition of a repetitive motion upon an effect.

The computer controlled installation for effecting the controlled movement of stage effects will comprise a computer with a keyboard and at least one monitor, a multiplicity of drive assemblies each operable to move a stage effect from an initial position to a second position, and a multiplicity of programmable logic controllers for controlling the drive assemblies to effect such movement of the stage effects. Interfaces are provided between the computer and the programmable logic controllers and between said programmable logic controllers and the drive assemblies.

The computer memory in the computer includes data indicative of the first and second positions of the effects, data indicating of the speed of movement of the effects between the positions, and the order and timing in which the effects are to be moved. The computer program in the computer includes instruction for effecting the movement of the effects in accordance with the order and timing, and instructions for displaying graphically on the monitor data concerning movement of the effects as the movement is taking place.

Desirably, the computer program also includes instructions for enabling variation in the speed of movement of the effects, as well as instructions for enabling movement upon the monitor of an icon indicative of an effect to a selected position and entry into memory of data concerning the selected position of the effect. It may also include instructions enabling superimposition upon an effect of another motion in addition to the movement between first and second positions.

Preferably, the program includes instructions enabling the computer to simulate actual operation of the entire program on the monitor, and instructions enabling the operator to emulate the operation of the program on the monitor and to effect entries to establish data for the movement.

Desirably, the keyboard includes special keys and the software includes instructions whereby an effect can be assigned to one of the special keys and operation of the special key will preclude movement of the effect. The keyboard also includes a potentiometer and the software includes instructions enabling manual operation of the potentiometer to vary the speed of movement of an effect. Multiple potentiometers may be each assigned to an effect and a master potentiometer may be provided with the software including instructions enabling manual operation of the master potentiometer to vary the speed of movement of all effects.

Desirably, the programmable logic controllers include parameters relating to undesirable movement of the effects deliver a signal to the computer upon detection of undesirable parameters to produce an alarm on the monitor.

BRIEF DESCRIPTION OF THE DRAWINGS

FIGS. 4A and 4B comprise is a printout of a portion of the cue listing for a typical stage program embodying the present invention;

FIGS. 8A and 8B comprise is a print of a typical monitor display illustrating data concerning effects in a cue.

DETAILED DESCRIPTION OF THE PREFERRED EMBODIMENTS

Figure 1:
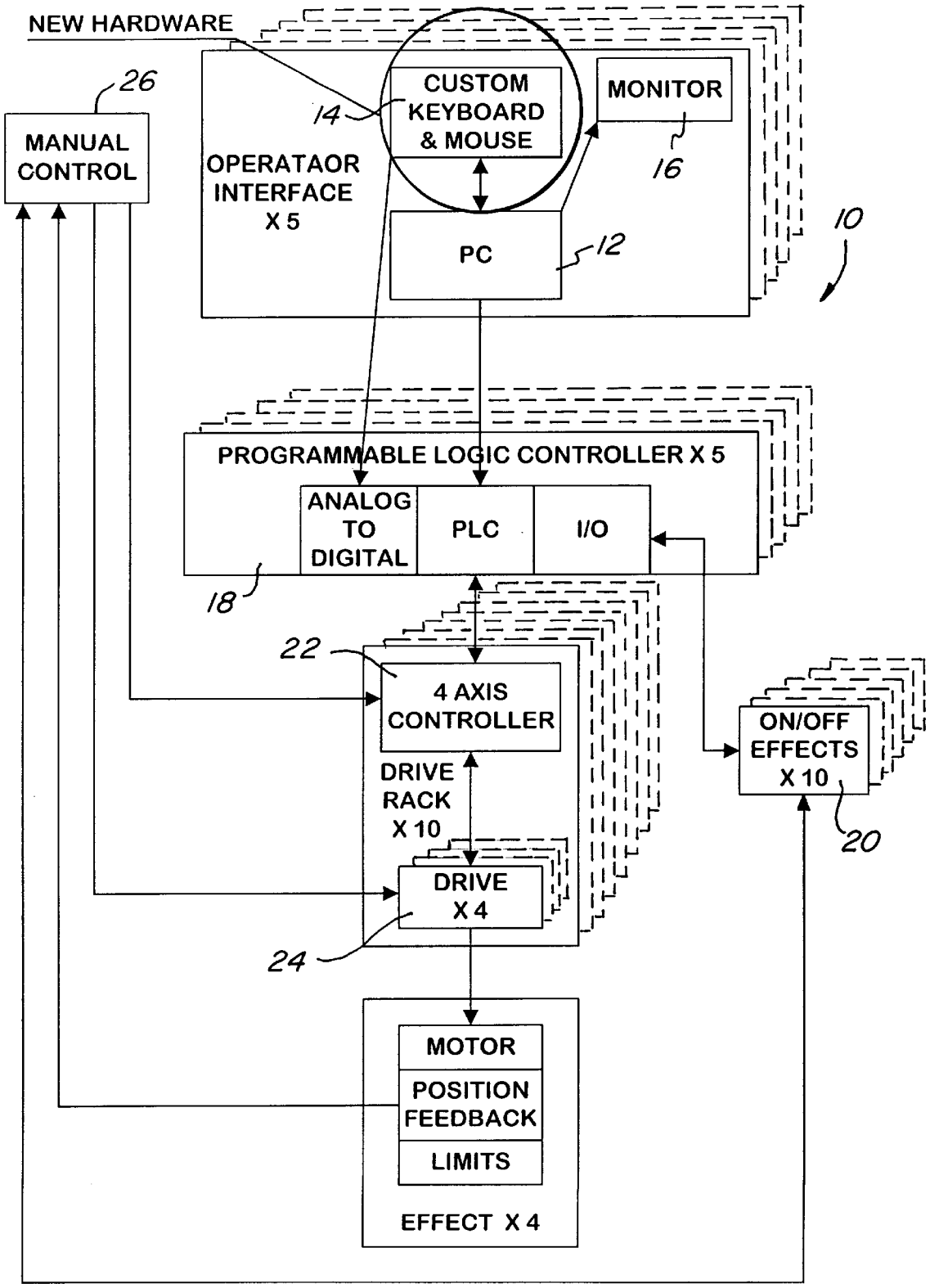
FIG. 1 is a diagrammatic illustration of a computer controlled installation embodying the present invention for operation of stage effects.

Turning first to FIG. 1, an installation embodying the present invention includes an operator interface generally designated by the numeral 10 and each comprising a computer 12, a custom keyboard generally designated by the numeral 14 and a monitor 16. Each operator interface 10 is coupled to a programmable logic controller 18 which has input/outputs to activate or deactivate on/off effects 20 and four axis controllers 22 which operate servodrives 24. Manual operated controllers 26 are also provided to operate the on/off effects 20, the controllers 22 and servodrives 24.

Circuitry provides feedback signals to the programmable logic controllers 18 and thence to the computer 12. In addition, there is circuitry from elements on the keyboard 14 directly to the controllers 18 as will be described hereinafter.

Figure 3A:
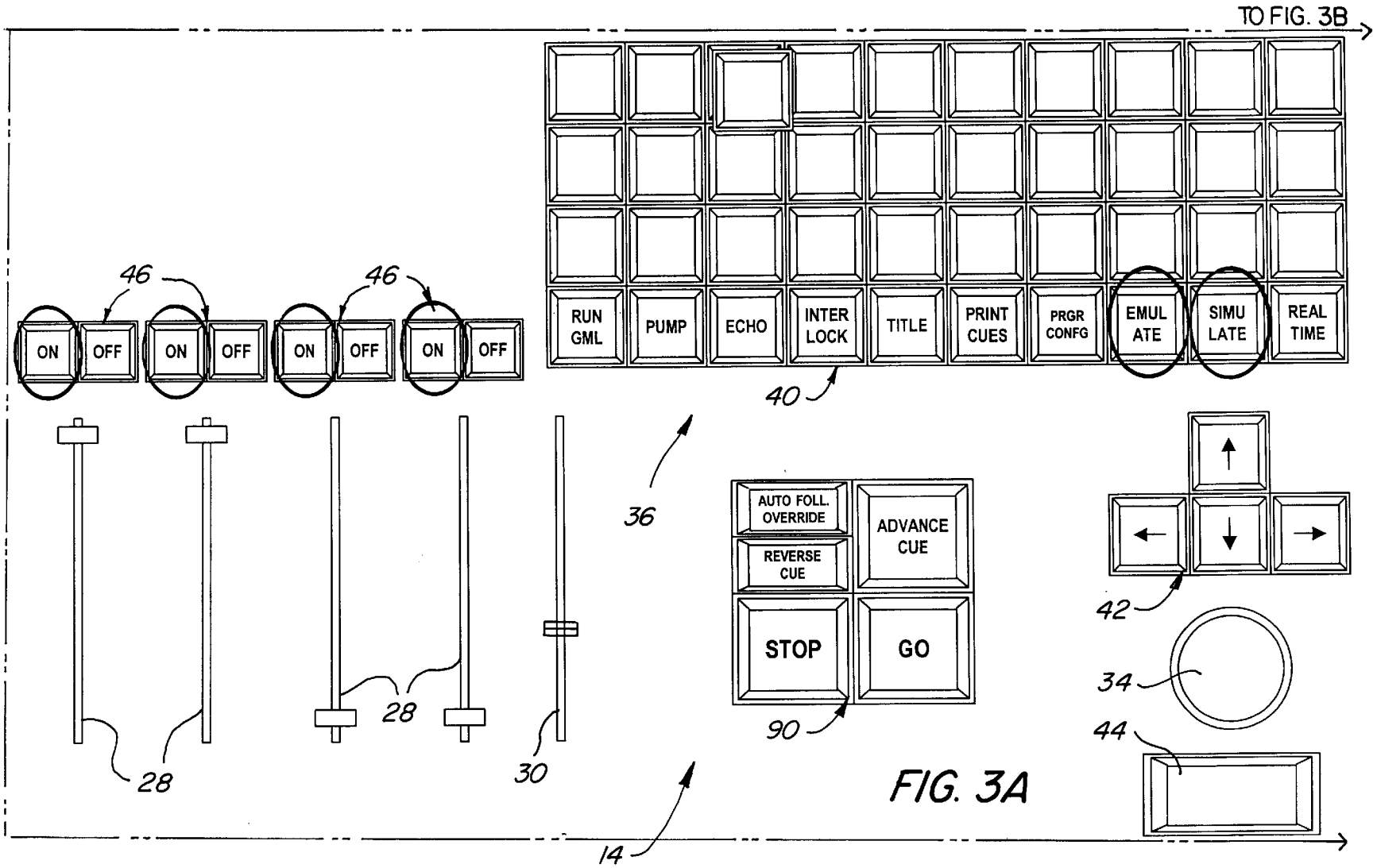
FIGS. 3A and 3B comprise is a plan view of the keyboard control for the installation.
Figure 3B:
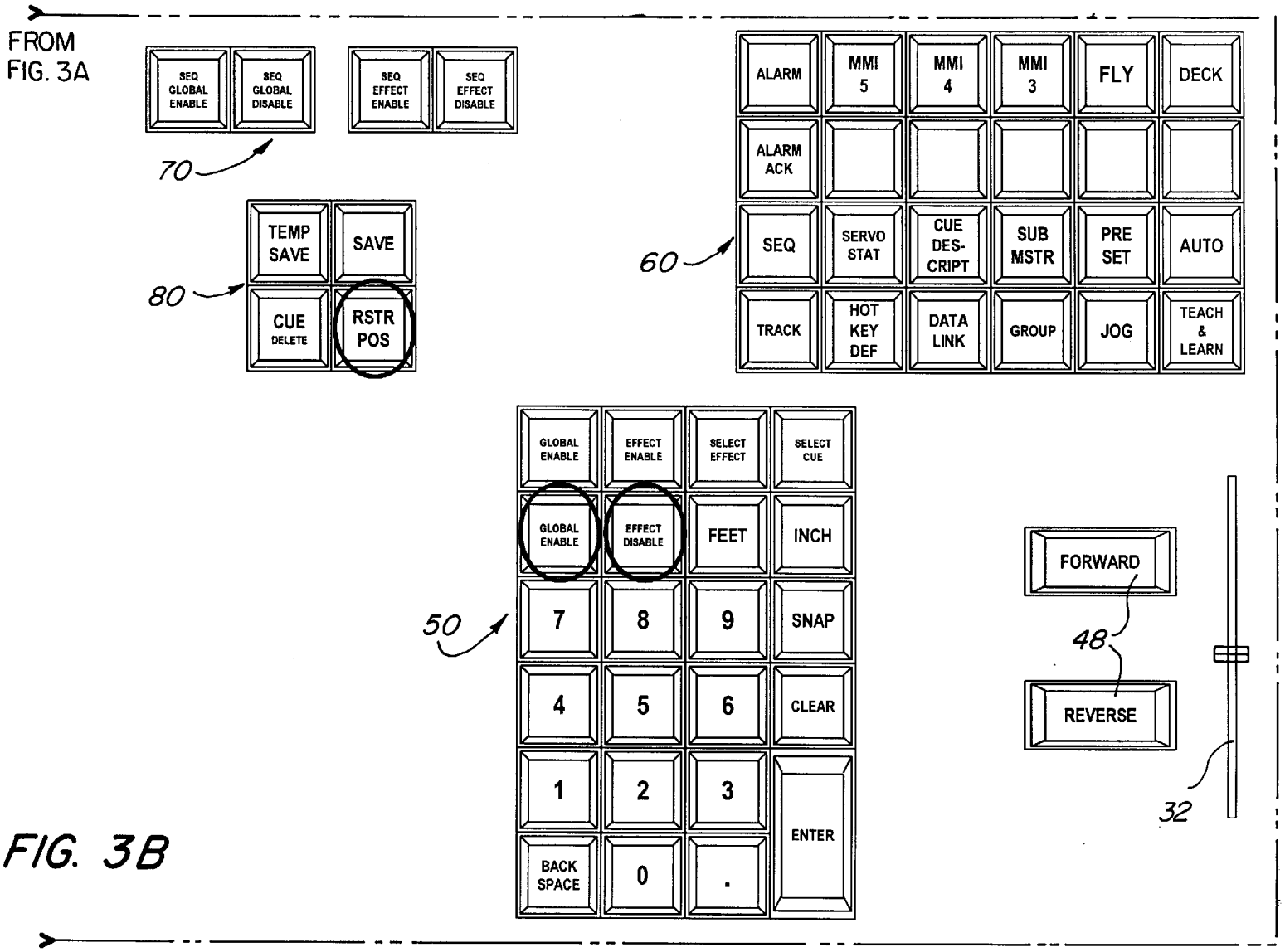

Turning next in detail to the keyboard 14 illustrated in FIGS. 3A and 3B, this includes four sub-master slide potentiometers 28, a master slide potentiometer 30 and a job potentiometer 32, all of which are directly connected to the programmable logic controllers 18 as indicated in FIG. 1. The potentiometers 28, 30, 32 enable the operator to override the programmed cues in the program as it is operating in the event of unanticipated events or problems which may occur. The four sub-master potentiometers 28 enable the operator to control the activity of an effect assigned to each of them. By moving the potentiometer 28, the movement of the effect associated with it can be manually accelerated, decelerated or stopped.

The master potentiometer 30 allows simultaneous action on all of the effects to increase or decrease the speed at which movements will be executed. If the operator adjusts the speed of execution of a single effect by a sub-master potentiometer 28 and then executes an adjustment by the master potentiometer 30, the adjustments are compounded.

The jog potentiometer 32 enables the operator to exercise fine or incremental adjustment of movement of an effect which is placed under its control by the operator.

The keyboard 14 also includes a track ball 34 which allows movement of a pointer on the monitor 16, and it can be used to locate beginning and ending positions of effects, and the software may then enter data as to these positions into the program as the data necessary to execute the moves to be produced by the logic controllers 18.

The keys 36 on the keyboard 14 are grouped in clusters and are desirably differentially colored to facilitate the operator's rapid identification of the desired key.

Thus, the hardware and software in the control installation of the present invention is able to combine computer control and manual control into a single interface which is manipulatable by a single keyboard. This eliminates stand alone manual controls and the voltage level control lines typically employed heretofore. The manual controls are synthesized into a digital output provided to the controllers 18 while the operator retains the "feel" of analog positioning and control.

The operator is able to assign one or more axes of motion to any one, or all, or any grouping of the sub-master potentiometers 28, and this can be done during execution of the program. This allows the operator to quickly and easily modify the speed of execution in any single axis by operation of any single potentiometer 28. The master potentiometer 30 allows proportional variation of the speed of movement of all effects.

Figure 2:
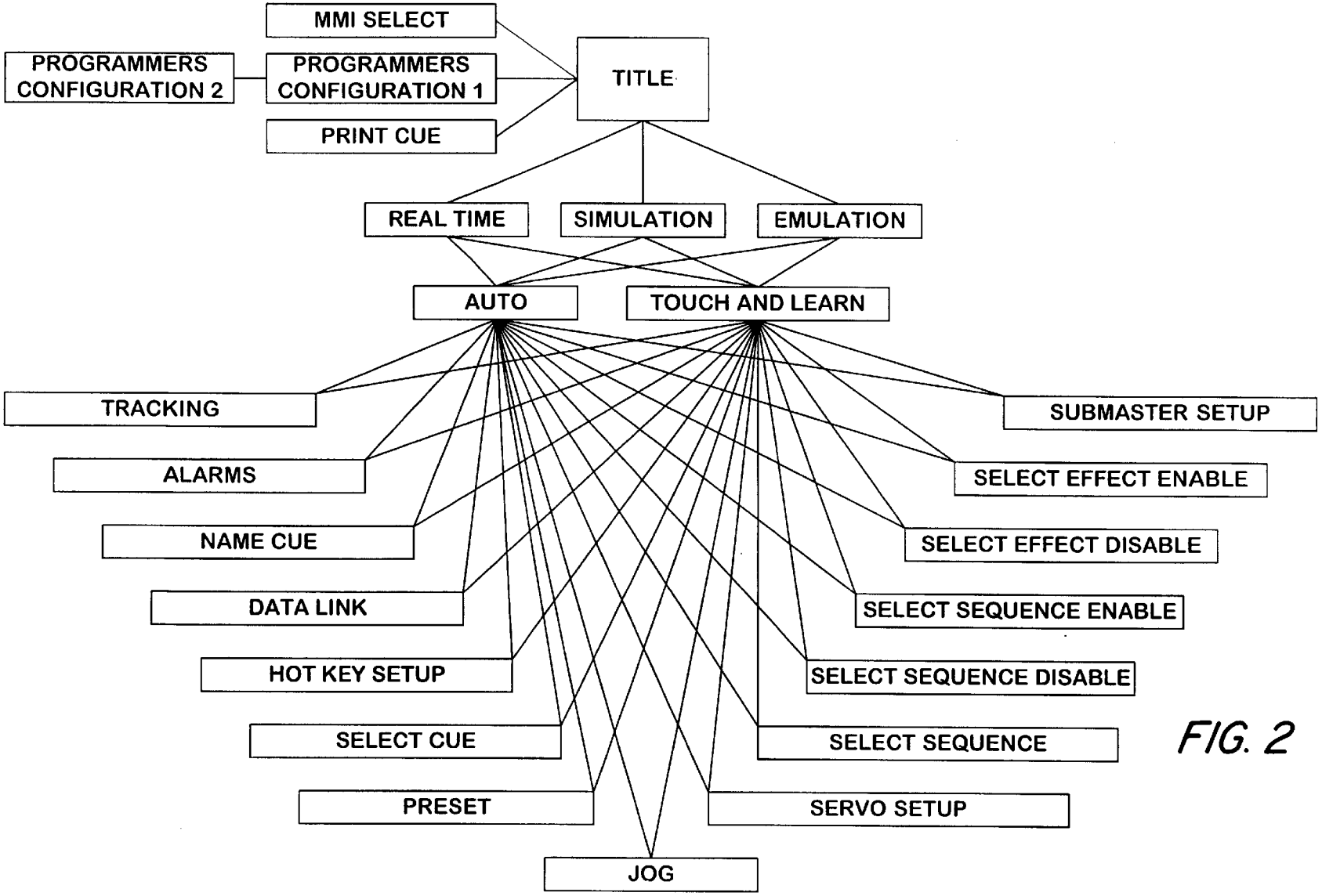
FIG. 2 is a diagrammatic illustration of the operator interface for the software used in the computer.

Turning next to FIG. 2, therein illustrated is the event flow in the software in the present invention. The operator may select any one of three modes of operation.

In the real time mode, the software executes the program.

In the simulation mode, the operator interface provides artificial input/output positional information to the programmable controllers 18 which in turn simulate execution of the commands and return data concerning such simulated execution to the computer 12 to display graphically on the monitor 16 the simulated movement of the effects without actual movement of the effects on the stage. This mode is useful for fine tuning the program in a new show and even in writing or revising the program for a new show.

In the emulation mode, the software emulates the operation of the programmable logic controller and allows the show designer to work on the stage movements for a show away from the theater or studio.

In any one of the three basic modes, the operator selects either the "teach and learn" mode or "automatic" mode. In the automatic mode, the program functions are executed and displayed on the monitor. This is also the case in the "teach and learn" mode, but the fields for date entry are active so that the operator may enter or alter existing data to revise the program. Heretobefore, different screens were generally utilized and considerable time was expended in effecting any changes.

In either of the selected modes, there are a number of modules or features which are enabled as indicated in FIG. 3.

The tracking feature allows the operator to change the parameters for an effect in a number of cues rather than having to modify the data for each cue. Thus, if the operator wishes to have the same parameters changed for a series of cues, he can specify that this (e.g., for cues No. 2–No. 7) and then return to the original parameters or enter new parameters for cue No. 8.

The alarm feature displays an alarm message on the monitor if any portion of the system is not functioning as programmed.

The Cue Description allows the operator to designate a word or words for a cue to facilitate identification of the cue rather than relying upon only a numeric designation. As a result, the monitor will display the name of the cue which is being executed or being changed.

The Data Link function reports on the status of communication links between the interface control and programmable controllers, and between the controllers and drivers. If there is any problem in communication, this is indicated on the monitor.

The Hot Key setup feature allows the operator to assign an effect or a group of effects to a "hot key" on the keyboard which can enable or disable the effect or effects. As a result, the operator can quickly respond to any problem involving the effect which may develop during operation of the program.

The Select Cue feature is conventional and allows the operator to select and display on the monitor the data concerning a cue without actually executing it.

The Preset feature is conventional and allows the operator to change the position parameter of an effect without effecting its actual movement. Exemplary of this feature is a change in the positional data for the effect to compensate for the stretch in a cable which would not alter the actual position(s).

The Jog feature enables the jog potentiometer 32 so that the operator may manually control the movement of an effect while the program is in operation.

The Servo Setup feature is password protected so that only an authorized technician can access it to tune the drives of the motors. By enabling this to be done at the computer installation rather than at the controllers, down time can be reduced.

The Select Sequence feature allows the operator to loop a sequence of events for a period of time such as rocking a boat to the left and rocking a boat to the right. Thus, two program instructions comprising a sequence can be looped.

The Select Sequence Disable feature allows the operator to disable the looping of events as described above.

The Select Sequence Enable feature allows an operator to select a loop of events.

The Select Effect Disable feature allows the operator to disable an effect during the show. If this feature is used, the effect will not move in a cue.

The Select Effect Enable feature allows the operator to enable the movement of an effect which has been disabled.

The Submaster Setup feature allows the operator to assign effects to a sub-master slide potentiometer on the keyboard on a cue-by-cue basis. When so designated and during execution of a cue, the operator may manually intercede to change the movement by moving the slide potentiometer controlling that effect.

Figure 4B:
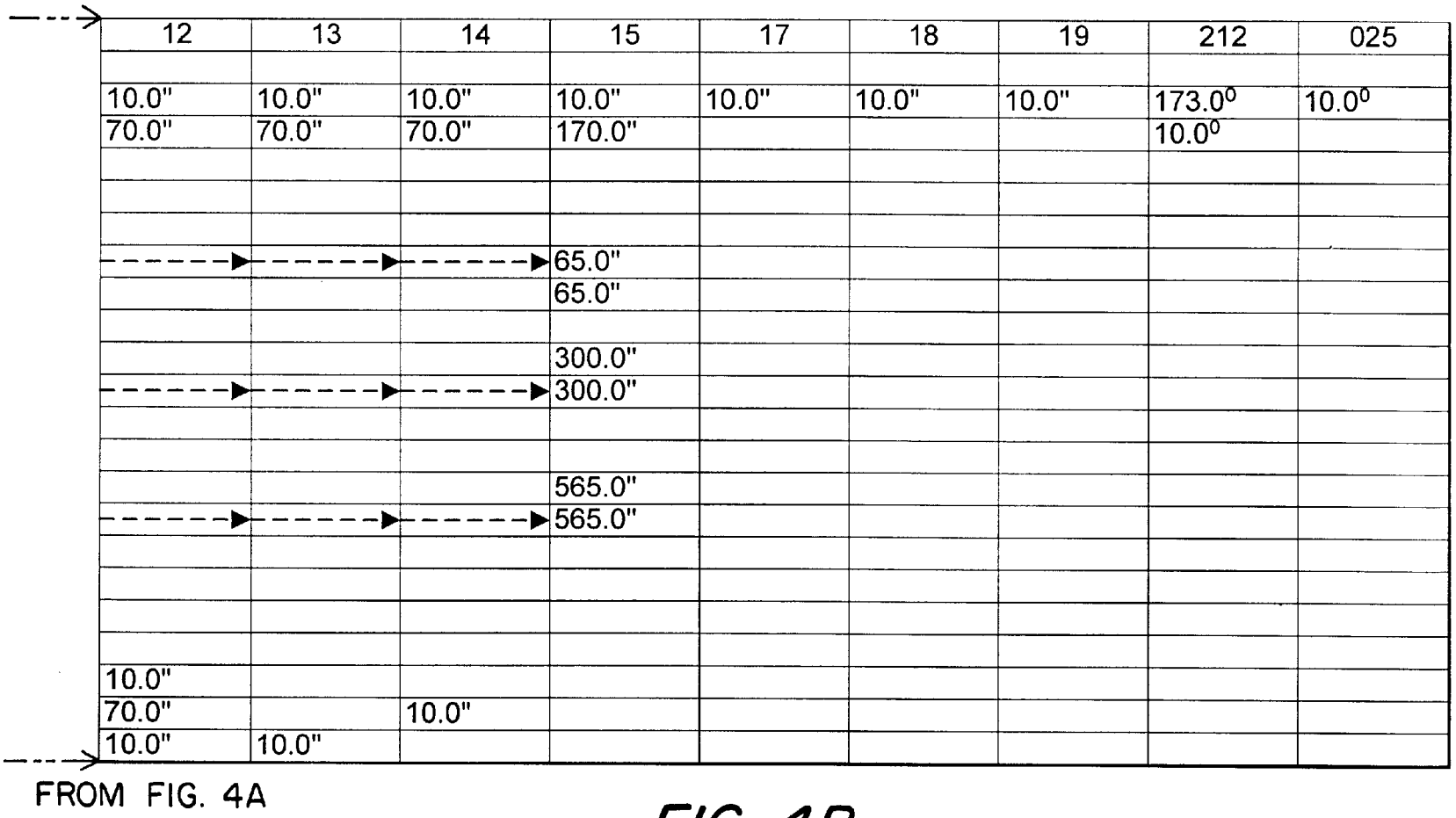

The Print Cue feature allows the operator to printout a list of cues, or a particular cue, and the effects which are controlled. A page of a typical printout appears as FIGS. 4A and 4B.

The Programmer's Configuration I allows the operator to provide a written description of effects and to name limits. For example, Effect No. 7, Position No. 1 may be described as a candle in the "up" position, and this description may be displayed on the monitor as the cue is being executed or as the program is being modified.

The Programmer's Configuration II feature allows the operator to change units, i.e., inches, degrees, etc. This is also password protected.

The Man-Machine Interface (MMI) feature allows the operator to control up to five different programmable controllers from one computer. Although normally only one controller will be under direct control of a computer, the data link feature in the new system provides a network among all of the programmable controllers so that an operator may switch a controller from another computer which may be experiencing problems.

Figure 5A:
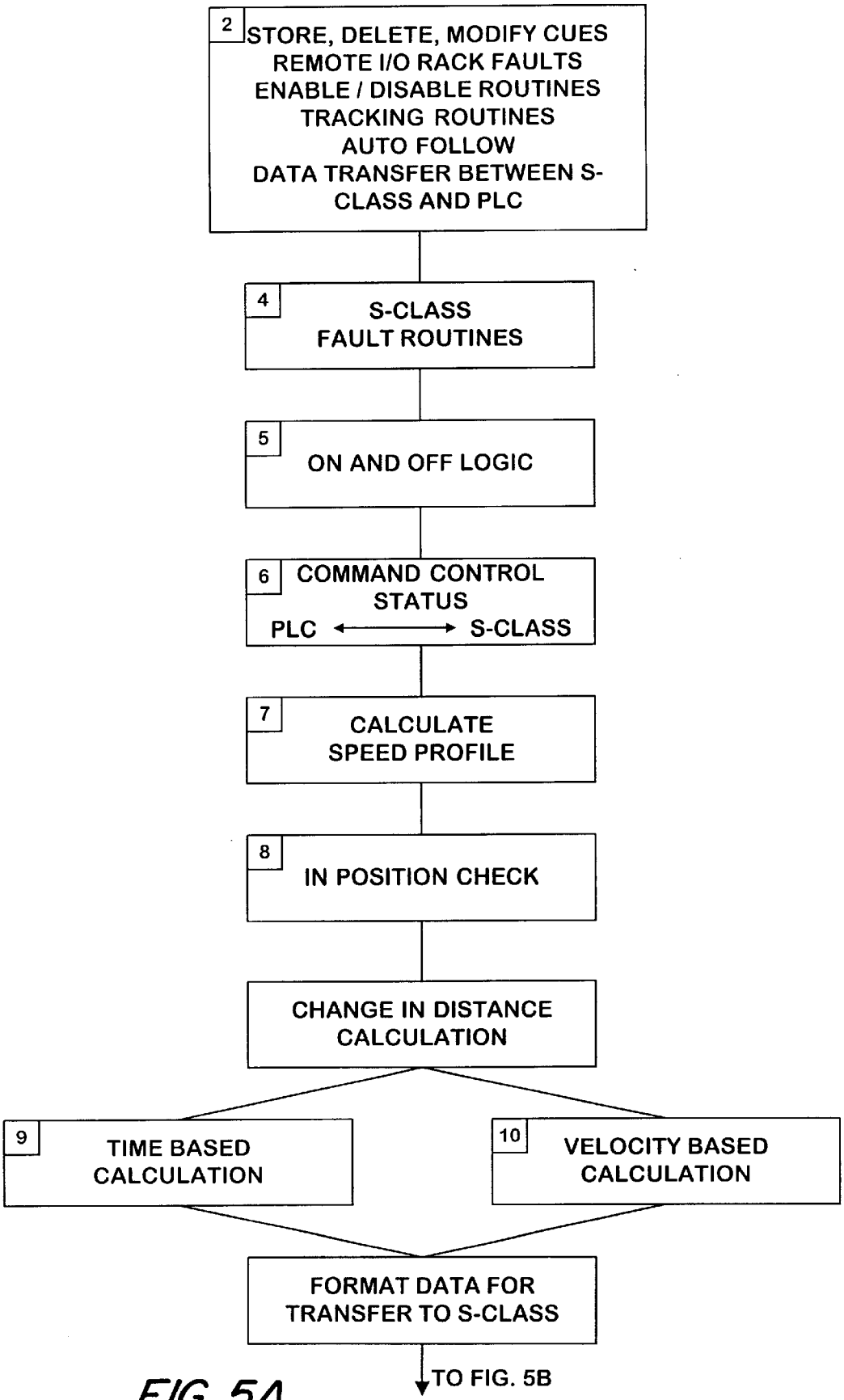
FIGS. 5A and 5B comprise is a diagrammatic illustration of the software utilized in the programmable controllers.
Figure 5B:
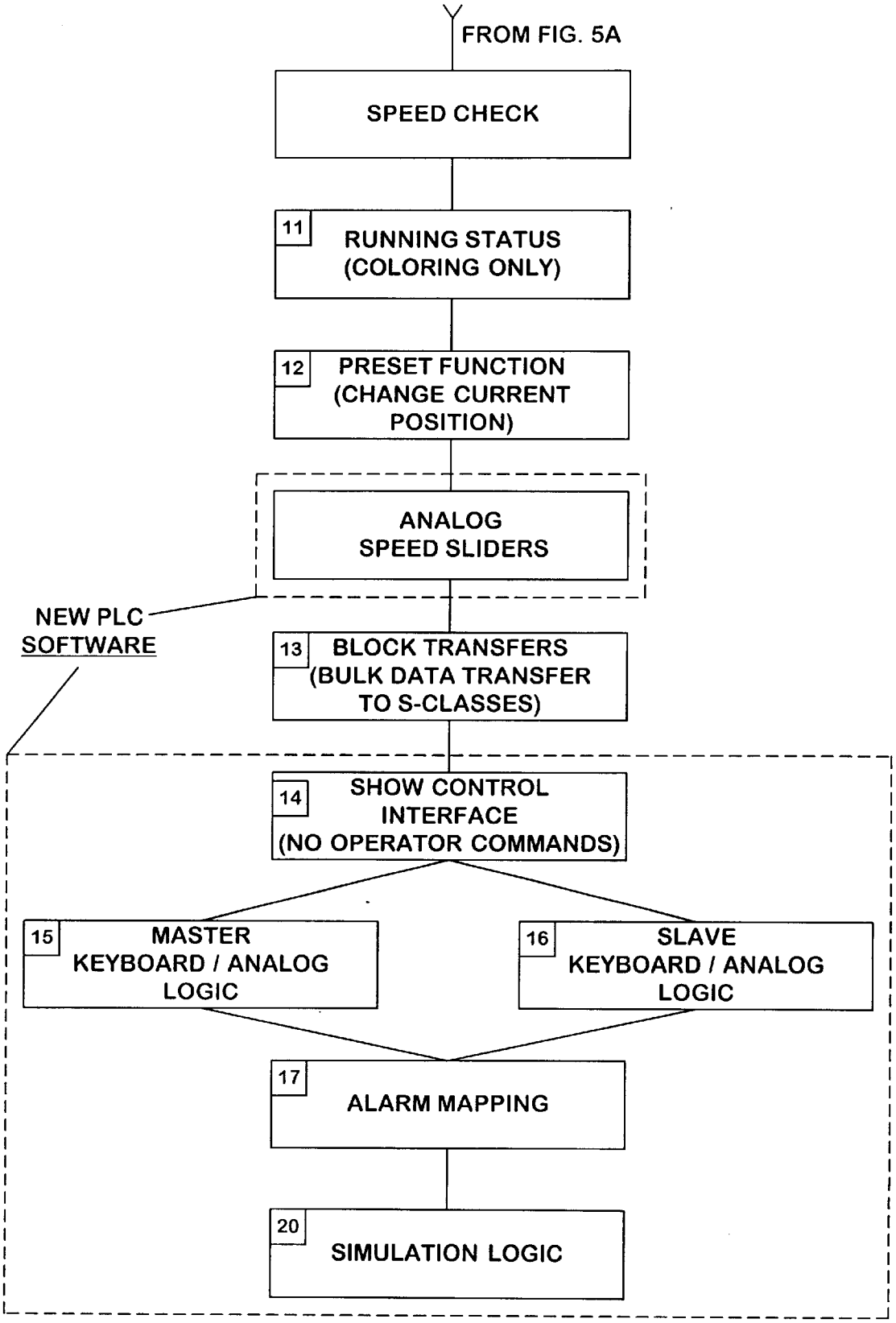

Turning now to FIGS. 5A and 5B, therein set forth are the components of the software utilized in the programmable logic controllers. The software will store, delete and modify cues for up to 50 effects, 40 of which are controlled by servomotors and 10 of which are simple on/off switches. This software executes all of the control functions which are enabled by the operator interface. Most of these functions have been provided in the programmable controllers heretofore utilized.

A first significant addition to this software is the Analog Speed Slider which analyzes the values being effected by the slide potentiometers and translates these values to the servodrives.

A second addition is the Show Control Interface which allows a show to be conducted in concert by several vendors. This module tells each vendor when to execute its part of the show.

The Master Keyboard/Analog Logic and Slave/Submaster Keyboard Analog Logic are modules which support the action of the slide potentiometers on the keyboard.

The Alarm Mapping Module provides for the alarms to be displayed on the monitor as a result of malfunctioning.

The Simulation Logic Module provides the artificial input/output positional information required for operation in the simulation mode.

Figure 6:
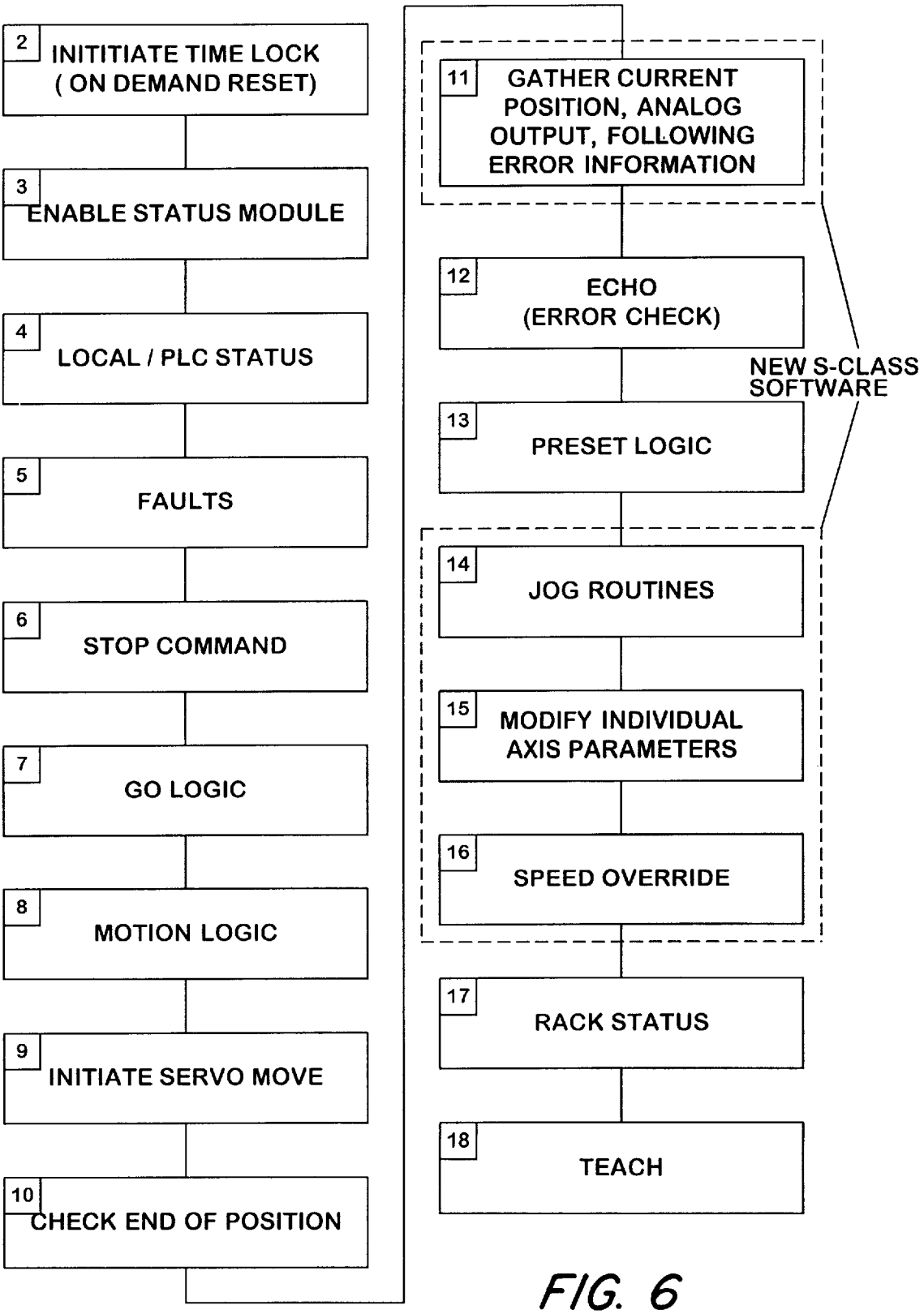
FIG. 6 is a diagrammatic illustration of the software which operates the four axis controllers.

FIG. 6 illustrates the S-class software which operates the four axis controllers, and it is generally conventional in that it is linear in nature and loops through the logic sequence described. Its purpose is to continuously look at the memory addresses assigned to the controlled effect and update the information as to position. However, in the present invention, the prior software has been modified to include several new modules.

Item 11 is a module which checks observed data with respect to the programmed data and establishes alarm conditions which will generate an alarm signal on the monitor.

Items 14–16 are added to enable the slide potentiometers to control the parameters of motion for the controlled effect. Item 14 allows the jog potentiometer to control the movement of an effect, and items 14 and 15 allow the sub-master and master slide potentiometers to direct the operation.

Turning now to the keyboard in FIGS. 3A and 3B, the keys can be related to the software functions described above.

The cluster of two rows of "Hot Keys" in the upper left center of the keyboard designated by the numeral 40 allows an operator to select specific effects and assign one to each pair of Hot Keys for rapid control. The upper key of a pair enables operation of the program for the effect and the lower key disables such operation. In the lowest row of this cluster are the keys which enable specific modules or modes including emulation, simulation, real time operation, printing of cues, etc.

Above the track ball 34 is a cluster of four cursor keys designated by the numeral 42. Below the track ball 34 is a select button 44 to enable the track ball 34 to engage and control the movement of an icon on the monitor 16.

Above each of the sub-master slide potentiometers 28 are On/Off Keys 46. The master slide potentiometer 30 is always active. To the left of the jog potentiometer 32 are Forward and Reverse Keys 48 to control the direction in which the controlled effect is to be moved while the movement of slide 32 controls the speed and extent of movement.

Further to the left of the jog potentiometer 32 is another key cluster 50 including a numeric keypad with a Backspace Key and a Decimal Point Key; the decimal point also functions as a delimiter for data entry in strings. The Enter Key is conventional and the Feet and Inch Keys allow designation of the appropriate measure during numeric entry. The Clear Key clears an entry which is in error, and the Snap Key allows the operator to enter into a cue data as to the current position of an effect displayed on the monitor. The Global Enable Key allows the computer operator to act on all effects simultaneously while the Global Disable Key terminates such control. The Effect Enable Key allows the operator to act upon one or more effects to be acted upon. The Effect Disable Key terminates such control. The Select Effect Key allows the operator to designate the effects to be acted upon, and the Select Cue Key allows him to select a particular cue upon which the operator will act.

The upper right key cluster 60 includes a key to enable the Alarm function and a key which requires the operator to acknowledge the alarm. In the top row are three Man/Machine Interface Keys so named which allow selection therebetween, and two additional Man/Machine Interface Keys labelled Fly and Deck. The latter keys enable action on the groups of effects which either fly or which move on the deck or floor.

In the third row are a Sequence Key to allow reviewing of the sequence of cues, a Servo Status Key which allows viewing of all drive parameters of all four axis controllers, a Cue Description Key which allows the operator to enter a word description for a cue, a Sub-Master Key which allows the assignment of an effect to a sub-master potentiometer, a Pre-Set Key which allows the operator to adjust position information for an effect, and an Automatic Key which allows automatic operation of multiple cues which are selected by the operator.

In the lowest row, the Track Key enables a change in effect to be continued through a number of cues; the Hot Key Definition key allows the operator to assign effects to the Hot Keys, and the Data Link Key allows the operator to check the status of network communications. The Group Key allows the creation of a group of effects to be controlled, the Jog Key enables the jog potentiometer 32, and the Teach and Learn Key enables the entry of position data directly from the monitor position of an effect.

In the upper left center is a cluster of keys 70 in which the Sequence Global Enable Key enables a sequence of motions to be continued throughout the whole program, and the Sequence Effect Key enables a single motion to be continued.

Below this cluster is another cluster of keys 80. The Temporary Save Key allows temporary changes of cue data on the monitor without changing permanent data. The Cue Delete Key erases a cue permanently, the Save Key saves a cue to memory, and the Restore Position Key will restore the current data as to position.

To the left of the track ball is another key cluster 90 which contains a Stop Key to bring the program to a slow stop, a Go Key to execute the next cue and an Advance Cue Key to move forward to the next cue. The Auto Follow Override Key allows manual advance to the next cue during automatic execution and the Reverse Key backs up to the previous cue.

The actual program code for the functions described above with respect to the software in the computer, the programmable logic controller and the four axis controllers will depend upon the microprocessors employed and the programming steps already used in connection with any existing system. The specific programming instructions will be readily apparent to those having skill in the art of programming such control systems. Conventional keyboard constructions may be utilized for the novel keyboard with the incorporation of the several slide potentiometers and the novel arrangement of the keys in clusters as described hereinbefore.

Figure 7:
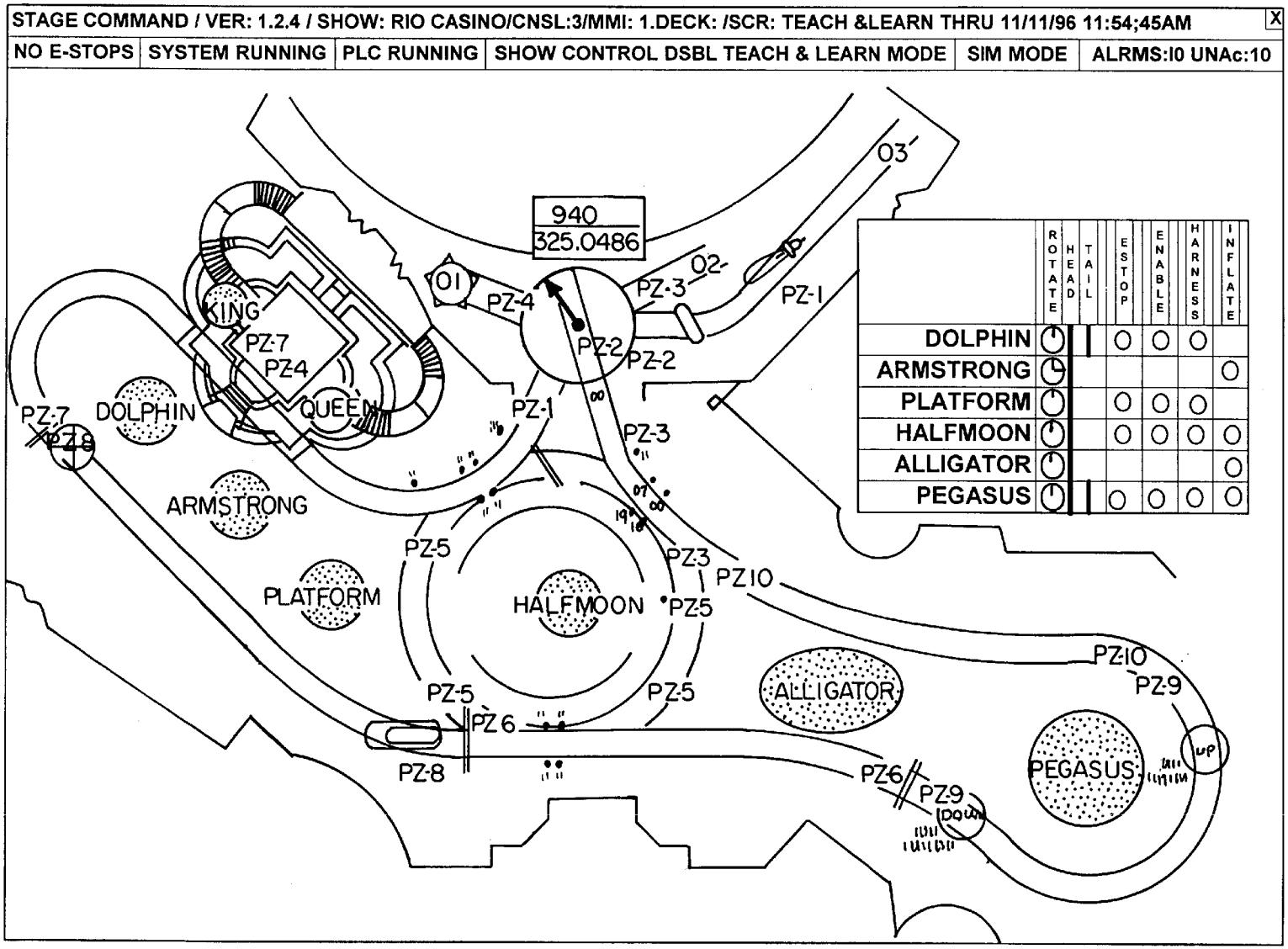
FIG. 7 is a print of a typical monitor display illustrating the positions of a number of props and their motions.

FIG. 7 is a print of a graphic display on the monitor graphically showing the positions of various props, various paths of movement and various positions during execution of a cue as well as a tabulation showing various instructions for each of several props.

Figure 8A:
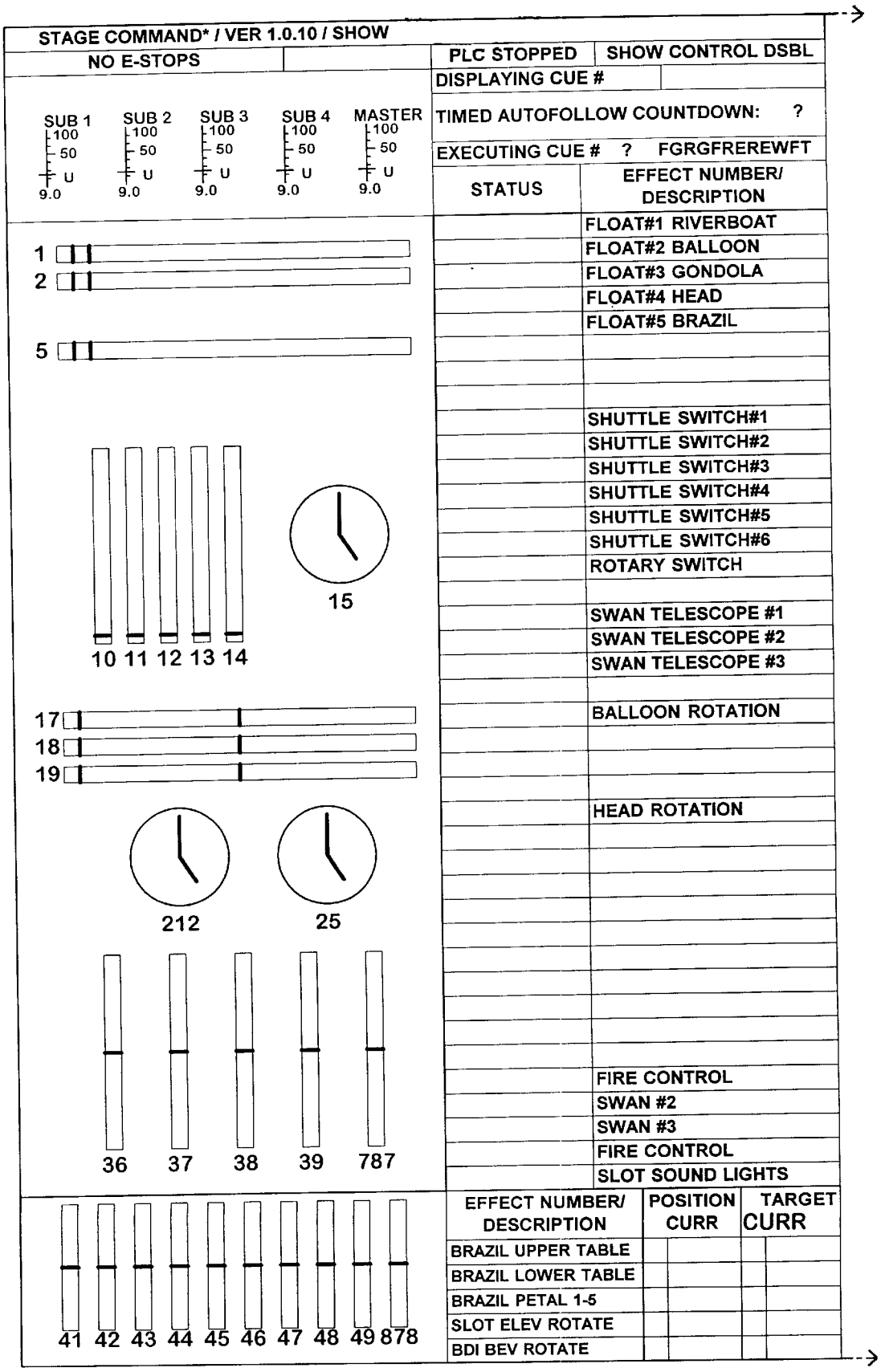

FIGS. 8A and 8B comprise a print of a graphic display on the monitor displaying the types of data provided in one screen display for a cue.

Other displays are generated by the other keys on the keyboard so that the operator can view the current cue, the next cur, etc. The motions of the effects can be graphically observed. Movement parameters can be displayed and modified as the program is being executed. The effect of the operation of the potentiometers can be observed.

In a typical large scale theatrical production, 4–5 separate computer installations will be employed with each one cooperating with a single programmable logic controller which in turn may control the 40 servomotors of ten 4-axis controllers as well as ten On/Off switches. By linking the computers and programmable logic controllers in a network, the control function of one computer installation which is experiencing problems may be transferred to another so that the production may continue without interruption.

In the event of a serious mishap, the operation of the entire program may be terminated immediately by a separate hardwired Emergency Stop which terminates all power to the servomotors. In the event of a less serious problem, the execution of the program may be less abruptly halted by the "Stop" button on the keyboard.

The keys on the keyboard are provided to facilitate rapid execution of desired aspects of the software. The slide potentiometers facilitate manual control of the motion of effects while the remainder of the program continues to run. The monitor displays graphically information on programming functions and data in the program as it is being executed and in a manner which facilitates operator comprehension. The simulation and emulation functions offer great flexibility in program design, development and modification.

Thus, the novel apparatus and method of the present invention provide greater operator control over the execution of cues and individual effects. The operator or designer can evaluate proposed motions and effects and enter data with respect thereto in a teach and learn mode and can also graphically observe simulated or emulated actions.

We claim:

1. In the computer controlled operation of motors to move a multiplicity of stage effects, the steps comprising:

(a) providing a computer installation including a computer having memory, a monitor and a custom keyboard control;

(b) entering into said memory of said computer data indicative of individual stage effects to be moved, their initial position, a second position to which they are to be moved and the speed of such movement;

(c) entering into said memory of said computer data indicative of the order in which said effects are to be moved;

(d) providing a stage installation including a multiplicity of effects spaced about said stage installation and drive assemblies to move said effects about said stage installation between said initial and second positions;

(e) coupling said computer to said drive assemblies for each of said effects to be moved, said drive assemblies each being operable to move one of said effects between said initial and second positions;

(f) providing in said computer a program to utilize said entered data to operate said drive assemblies in said order to move said effects between said initial and second positions;

(g) running said computer program to effect said movement of said effects; and (h) while said program is running and effecting movement of said effects, displaying on said monitor data concerning movement of said effects and representational movement of icons associated with said effects and using said keyboard to modify at least some of said data with respect to at least one of said effects and thereby its movement in said stage installation.

2. The computer controlled movement of stage effects in accordance with claim 1 including the step of providing programmable logic controllers for said drive assemblies to execute the movement of said effects which is defined by said entered data.

3. The computer controlled movement of stage effects in accordance with claim 2 wherein said computer keyboard includes at least one manually variable controller for varying said speed of movement of at least one of said effects and including the step of manually moving said variable controller to vary the operation of at least one of said logic controllers and thereby the speed of the drive assembly associated therewith.

4. The computer controlled movement of stage effects in accordance with claim 3 wherein a manually variable controller is provided for each of a selected multiplicity of effects and including the step of selectively operating said variable controllers.

5. The computer controlled movement of stage effects in accordance with claim 1 wherein a master variable controller for all of the effects is provided and including the step of operating said master controller to vary the speed of movement of all of the effects.

6. The computer controlled movement of stage effects in accordance with claim 4 wherein a variable jog controller is provided and including the steps of selecting an effect to be operated thereby and manually operating said jog controller to manually control the movement of the selected effect.

7. The computer controlled movement of stage effects in accordance with claim 1 including the steps of using said keyboard to move an icon representing an effect to a desired position on the display on said monitor and entering into said memory data indicative of said selected position.

8. The computer controlled movement of stage effects in accordance with claim 1 including the step of imparting repetitive motion to an effect.

9. The computer controlled movement of stage effects in accordance with claim 1 including the step of providing a simulation mode in said computer program and executing the steps of the program in said mode and graphically presenting the simulated movement on said monitor.

10. The computer controlled movement of stage effects in accordance with claim 1 including the step of providing an emulation mode in said computer program to enable emulation of movement of effects by the operator and entering into said memory data representative of said emulated movement.

11. The computer controlled movement of stage effects in accordance with claim 1 wherein said keyboard includes a multiplicity of "hot keys" and including the steps of assigning a multiplicity of said effects to individual "hot keys" and using one of said hot keys to disable movement of the associated effect while said program is running.

12. The computer controlled installation for effecting the controlled movement of stage effects comprising:

(a) a computer with a keyboard and at least one monitor;

(b) a stage installation including a multiplicity of effects spaced about said stage installation;

(c) a multiplicity of drive assemblies each operable to move a stage effect from an initial position to a second position;

(d) a multiplicity of programmable logic controllers for controlling said drive assemblies to effect such movement of the stage effects;

(e) interfaces between said computer and said programmable logic controllers and between said programmable logic controllers and said drive assemblies;

(f) computer memory in said computer including:

(i) data indicative of the first and second positions of the effects;

(ii) data indicative of the speed of movement of the effects between said positions;

(iii) date indicative of the order and timing in which the effects are to be moved;

(g) a computer program in said computer including:

(i) instructions for effecting said movement of the effects in accordance with said order and timing;

(ii) instructions for displaying graphically on said monitor data concerning movement of the effects as said movement is taking place and representational movement of icons associated with said effects; and (iii) instructions enabling keyboard control to modify at least some of said data with respect to movement of at least one of said effects as said computer program is operating.

13. The computer controlled installation in accordance with claim 12 wherein said program also includes instructions for enabling variation in the parameters of movement of the effects.

14. The computer controlled installation in accordance with claim 12 wherein said computer program includes instructions for enabling movement upon said monitor of an icon indicative of an effect to a selected position and for enabling entry into memory of data concerning the selected position of the effect.

15. The computer controlled installation in accordance with claim 12 wherein said computer program includes instructions enabling superimposition upon an effect of another motion in addition to said movement between first and second positions.

16. The computer controlled installation in accordance with claim 12 wherein said computer program includes instructions enabling the computer to simulate graphically actual operation of the entire program on said monitor.

17. The computer controlled installation in accordance with claim 12 wherein said computer program includes instructions enabling the operator to emulate the operation of the program graphically on said monitor and to effect entries to establish data for said movement.

18. The computer controlled installation in accordance with claim 12 wherein said keyboard includes special keys and said software includes instructions whereby an effect can be assigned to one of said special keys and operation of said special key will preclude movement of the effect.

19. The computer controlled installation in accordance with claim 12 wherein said keyboard includes a potentiometer and said software includes instructions enabling manual operation of said potentiometer to vary the speed of movement of an effect.

20. The computer controlled installation in accordance with claim 12 wherein said keyboard includes multiple potentiometers each assigned to an effect and wherein said software includes instructions enabling manual operation of said potentiometers to vary the speed of movement of the effects associated therewith.

21. The computer controlled installation in accordance with claim 12 wherein said keyboard includes a master potentiometer and said software includes instructions enabling manual operation of said master potentiometer to vary the speed of movement of all effects.

22. The computer controlled installation in accordance with claim 12 wherein said programmable logic controllers include parameters relating to undesirable movement of said effects and said controllers deliver a signal to said computer upon detection of said undesirable parameters to produce an alarm on said monitor.

23. The computer controlled installation in accordance with claim 21 wherein said keyboard includes a jog potentiometer and said software includes instructions enabling manual operation of said master potentiometer to control the movement of an effect.

* * * * *